United States Patent [19]

Paredes

[11] 4,328,533

[45] May 4, 1982

[54] ILLUMINATED SAFETY GARMENT

[76] Inventor: Ernest Q. Paredes, 461 S. 74th Pl., Mesa, Ariz. 85208

[21] Appl. No.: 15,381

[22] Filed: Feb. 26, 1979

[51] Int. Cl.[3] ..... F21L 15/06; G02B 5/12

[52] U.S. Cl. ..... 362/108; 2/102; 2/DIG. 2; 350/98

[58] Field of Search ..... 362/103, 105, 106, 107, 362/108; 340/321, 331; 2/102, 108, DIG. 2; 350/98

[56] References Cited

U.S. PATENT DOCUMENTS

| | | | |
|---|---|---|---|
| 1,047,700 | 12/1912 | Pressman | 2/102 |
| 1,773,442 | 8/1930 | Speh | 2/DIG. 2 |
| 1,777,379 | 10/1930 | Powell et al. | 340/321 |
| 2,070,818 | 2/1937 | Winckler | 362/108 |
| 2,130,439 | 9/1938 | Wheeler | 350/98 |
| 2,378,075 | 6/1945 | Frecska | 362/108 |
| 2,696,617 | 12/1954 | Worcester | 2/102 |
| 2,816,284 | 12/1957 | Campanell | 362/103 |
| 2,978,696 | 4/1961 | Keller et al. | 362/106 |
| 3,083,295 | 3/1963 | Baker | 340/321 |
| 3,153,745 | 10/1964 | Gurian et al. | 340/321 |
| 3,561,394 | 2/1971 | Pickens | 2/102 |
| 3,837,007 | 9/1974 | Girest | 350/98 |
| 3,849,804 | 11/1974 | Rakow | 2/108 |
| 3,901,579 | 8/1975 | Demerest | 350/98 |
| 3,944,803 | 3/1976 | Chao | 340/331 |
| 4,106,121 | 8/1978 | Belson | 2/102 |
| 4,112,482 | 9/1978 | Powell | 362/108 |

FOREIGN PATENT DOCUMENTS

| | | | |
|---|---|---|---|
| 6600459 | 1/1966 | Netherlands | 340/321 |
| 737593 | 9/1955 | United Kingdom | 362/108 |
| 1144938 | 2/1968 | United Kingdom | 362/108 |

*Primary Examiner*—L. T. Hix
*Assistant Examiner*—Alan Mathews
*Attorney, Agent, or Firm*—Howard I. Podell

[57] ABSTRACT

An illuminated safety harness adapted for wearing with or without a vest, and having a battery compartment in its belt connected through a switch to lamp sockets fixed on each shoulder. Each lamp socket is designed for a flashing light bulb. The harness has a plurality of reflective, luminescent or phosphorescent patches on its front and back to increase the visibility of the wearer during conditions of poor visibility. The elements of the electrical system are held in the harness which is fitted with snaps so it may be fastened to a vest, or to straps which fasten it directly about a user. The vest is preferably reversible with one side of a white reflective material for night use and the opposed side of a brightly colored material for daytime use.

6 Claims, 7 Drawing Figures

ILLUMINATED SAFETY GARMENT

FIELD OF THE INVENTION

This invention relates generally to an illuminated safety harness adaptable for fitting about a vest and in particular to a harness fitted with flashing lights, that may be worn directly about a user.

DESCRIPTION OF THE PRIOR ART

The prior art, as exemplified by U.S. Pat. Nos. 2,378,075; 2,978,696; 2,816,284; 3,153,745; 3,083,295; and 3,944,803, is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or to operate. As a result of the shortcomings of the prior art, typified by the above, there has developed a substantial need for improvement in this field.

The principal object of this invention is to provide a device or article of readily merchandizable character which combines simplicity, strength and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practice of the invention, the objects and advantages being realized and attained by means of the methods, processes, instrumentalities and combinations particularly pointed out in the appended claims.

SUMMARY OF THE INVENTION

This invention resides in an illuminated safety harness adapted for wearing with or without a vest, and having a battery compartment in its belt connected through a switch to lamp sockets fixed on each shoulder. Each lamp socket is designed for a flashing light bulb. The harness has a plurality of reflective, luminescent or phosphorescent patches on its front and back to increase the visibility of the wearer during conditions of poor visibility. The elements of the electrical system are held in the harness which is fitted with snaps so it may be fastened to a vest, or to straps which fasten it directly about a user. The vest is preferably reversible with one side of a white reflective material for night use and the opposed side of a brightly colored material for daytime use.

BRIEF DESCRIPTION OF THE DRAWING

In the accompanying drawing, in which is shown one of the various possible illustrative embodiments of this invention, wherein like reference character identify the same or like parts:

FIG. 7 is a detail perspective exploded front view of the harness and attachment unit.

DESCRIPTION OF THE PREFERRED EMBODIMENTS

Figure 1:
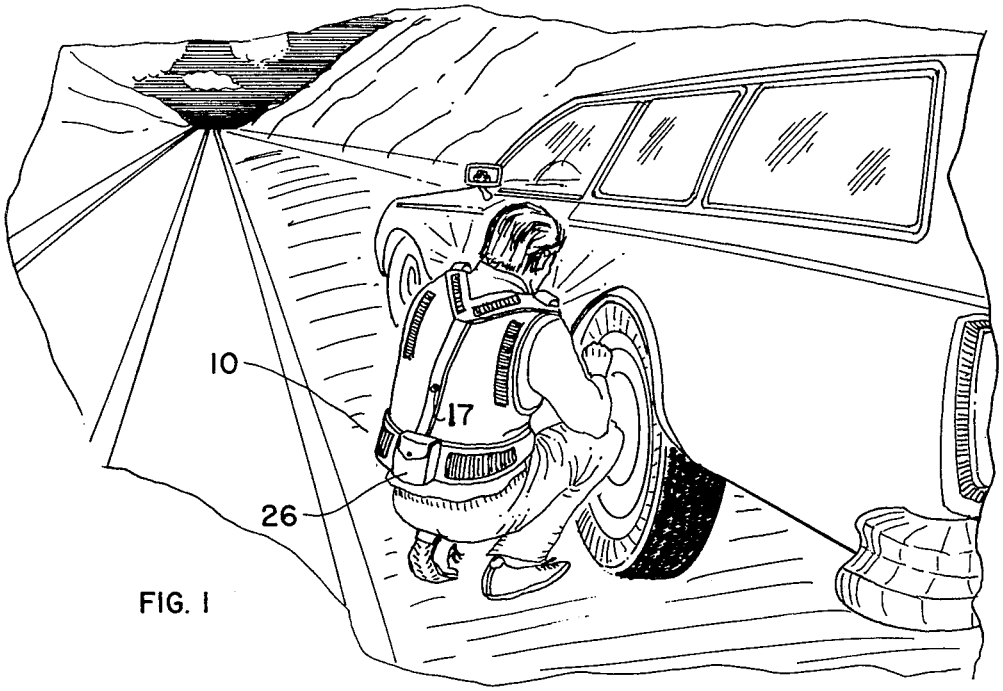
FIG. 1 is a view in perspective showing a person wearing the harness about the vest of this invention while repairing a vehicle.
Figure 2:
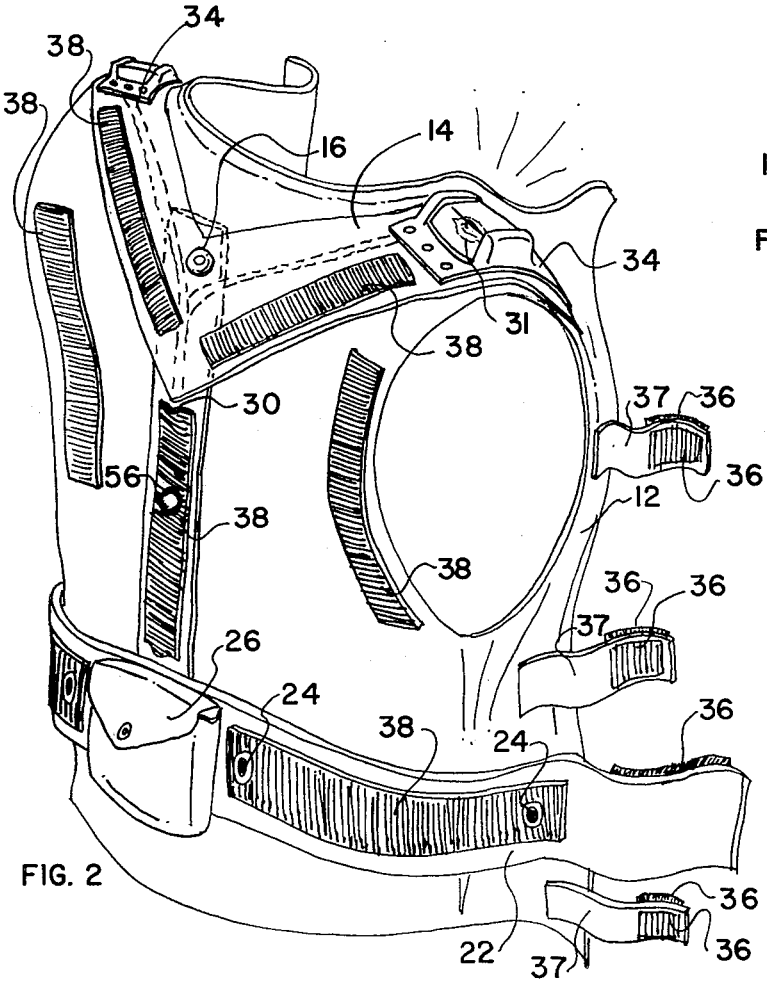
FIG. 2 is a view in perspective of the vest and harness.
Figure 3:
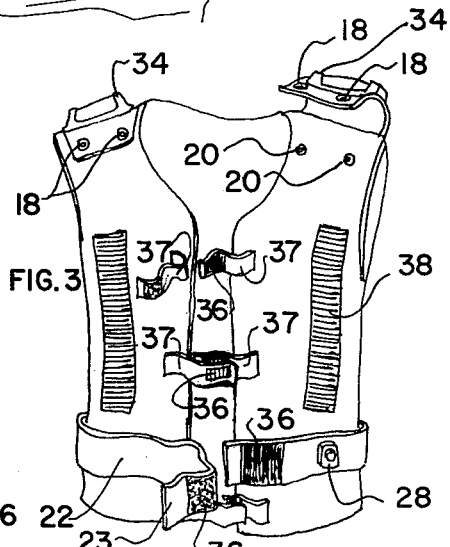
FIG. 3 is a front view thereof.
Figure 4:
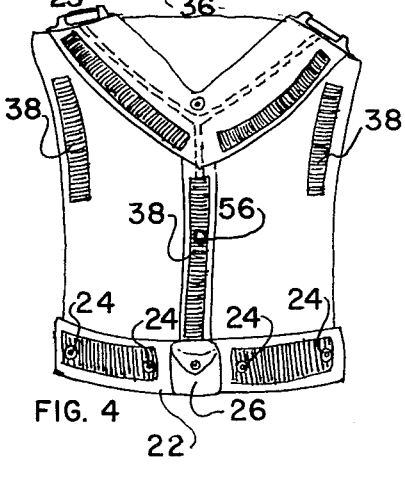
FIG. 4 is a rear view of same.

With reference to the drawing, there is shown and illustrated in FIGS. 1–4 a safety harness and vest assembly constructed in accordance with the principles of the invention and designated generally by reference character 10. The illustrated tangible preferred embodiment of the invention includes a reversible vestlike outer garment 12 (FIG. 2) made of any usual material. A "Y" shaped harness 14 is externally secured to the vest 12 by mating snaps 16 below the back of the neck and to the front of the shoulders by similar snaps 18, (FIG. 3) which matingly engage snap fasteners 20 on the vest. A belt element 22 is integral with the harness 14 and is secured to the back of vest 12 by mating snaps 24 which engage mating snaps on the vest.

A battery compartment or power pack 26 is attached to belt element 22 and contains a six-volt battery connected to ON-OFF switch 28 (FIG. 3) by wires passing through the harness in circuit with wires 30 leading to lamp assemblies 34, each fixed to a top of the shoulders of assembly 14. A flash bulb 31 such as a General Electric bulb type 40 is fitted in a lamp assembly socket in each assembly 34.

A plurality of mating adhesive strips such a Velcro-type bands 36 are provided on straps 37 in the front of vest garment to close same, with the adhesive bands 36 being located on each side of the vest strap 37 so that vest 12 may be reversed.

Similar Velcro-type bands 36 are mounted on the opposed end section 23 of harness belt 22.

A plurality of light reflecting or luminescent strips 38 are provided on the front and the back of the harness.

Figure 5:
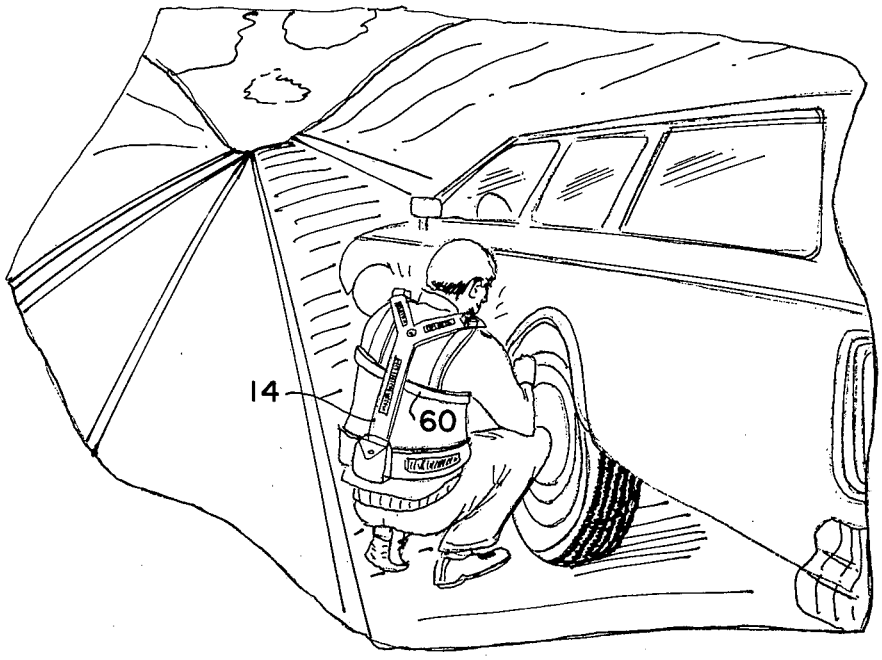
FIG. 5 is a perspective view of a person wearing the harness.
Figure 6:
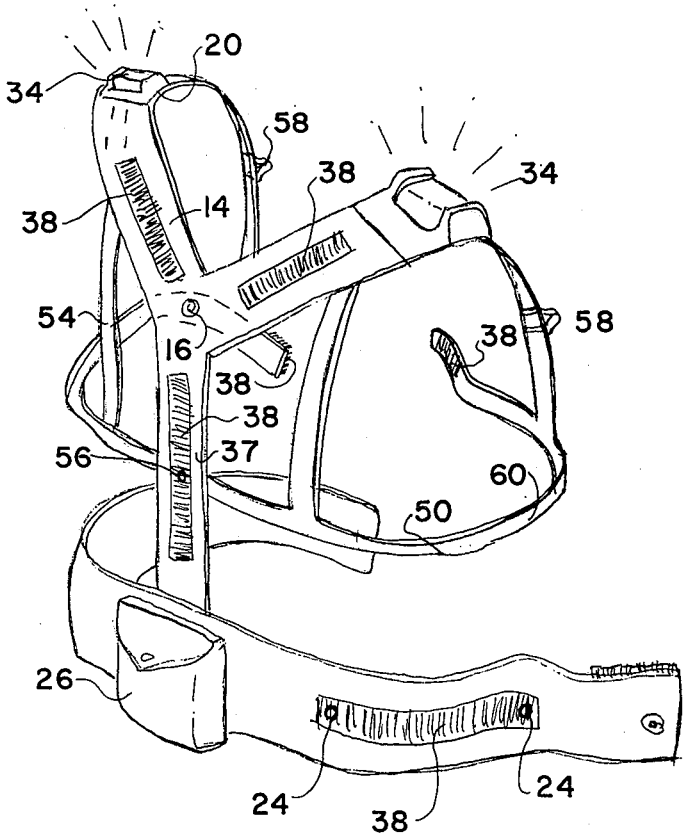
FIG. 6 is a perspective view of the harness and attachment strap unit.

It will be appreciated that the present assembly can be independent of garment 12 and be used as a harness by the wearer, when fastened to strap assembly 50 as shown in FIGS. 5–6.

As shown in FIGS. 5–6, strap assembly 50 may be fastened to harness 14 in lieu of vest 12 so that harness 14 may be worn directly about the user's waist and shoulders without vest 12.

Strap assembly 50 comprises a pair of spaced V-shaped flexible straps 54 each of a size to hang over a shoulder of a user, with the snap fasteners 20 mounted to the upper forward section of each strap 54 to engage a snap fastener 18 of the harness. Each strap 54 is fitted on its forward section with a buckle mechanism 58 for adjusting the length of the strap 54 with each strap 54 fixed at each end to a horizontal strap 60. Strap 60 is fitted at its rear with a snap fastener adaptable for engagement with a snap fastener 56 on the rear vertical leg 37 of harness 14, so as to be spaced from belt element 22, as shown in FIG. 6, with each end section of strap 60 fitted with Velcro-type adhesive bands 38.

Vest 12 is fitted with snap fasteners 20 and snap fasteners that are located to engage harness snap fasteners 16, 56 and 24 on both sides of the vest so that vest 12 may be reversed and fastened on either side to the harness. Preferably one side of vest 12 is colored white of reflective material for use at night, while the other side is colored of a bright color such as red or blaze orange for use during the daytime.

While flashing light bulbs are preferably mounted in the sockets of light assemblies 34, continuous non-flashing bulbs may be used in one or both light assemblies and furthermore, a flasher mechanism may be connected to the battery pack assembly to cause such continuous type light bulbs to flash when so desired.

The present garment is useful for safety and rescue situations in airports, railroads, highways, snow, hunting or the like, where poor visibility may occur.

The operation and use of the invention herein above described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. Safety garment apparatus adapted to be worn in selective attached combinations of separate units of the apparatus by a user, comprising, in combination:

a first unit in the form of harness means for supporting an electrical illumination system, including a first portion adapted to be disposed on one shoulder of the user, a first lamp assembly disposed on the first portion at the user's shoulder, a second portion adapted to be disposed on the other shoulder of the user, a second lamp assembly disposed on the second portion at the user's other shoulder, a belt adapted to be secured around the user's waist, means for securing the first and second portions to the belt, battery means secured to the belt of the user's back, wires extending from the battery to the first and second lamps, and switch means secured to the belt for connecting and disconnecting the lamps and the battery;

light reflecting means secured to the harness means for reflecting light;

a second unit in the form of a vest adapted to be worn by the user; and a third unit in the form of strap means securable to the first and second portions for securing the harness means to the user; and fastener means mounted on each said unit for selectively detachably securing the harness means alternatively to the vest or to the strap means, so that the user may secure the harness means about his person when he is wearing either the vest or the strap means.

2. The apparatus of claim 1 in which the strap means includes a first strap extending over the one shoulder of the user, a second strap extending over the other shoulder of the user, and a horizontal strap secured to the first and second straps and extendable about the user's body and above the belt.

3. The apparatus of claim 2 in which each lamp assembly is shaped to project light simultaneously upwards, forwards and rearwards of the user in the erect position of the user.

4. Safety garment apparatus adapted to be worn in selective attached combinations of separate units of the apparatus by a user, comprising, in combination:

a first unit in the form of harness means for supporting an electrical illumination system, including a first portion adapted to be disposed on one shoulder of the user, a first lamp assembly disposed on the first portion at the user's shoulder, a second portion adapted to be disposed on the other shoulder of the user, a second lamp assembly disposed on the second portion at the user's other shoulder, a belt adapted to be secured around the user's waist, means for securing the first and second portions to the belt, battery means secured to the belt of the user's back, wires extending from the battery to the first and second lamps, and switch means secured to the belt for connecting and disconnecting the lamps and the battery;

light reflecting means secured to the harness means for reflecting light;

a second unit in the form of a vest adapted to be worn by the user; and a third unit in the form of strap means securable to the first and second portions for securing the harness means to the user; and means for selectively securing the harness means alternatively to the vest or to the strap means, so that the user may secure the harness means about his person when he is wearing either the vest or the strap means, in which the strap means includes a first strap extending over one shoulder of the user, a second strap extending over the other shoulder of the user, and a horizontal strap secured to the first and second straps and extendable about the user's body spaced about from and above the belt.

5. The apparatus of claim 4 in which the means for selectively securing the harness means alternatively to the vest or to the strap means comprise snap fasteners, with the harness fitted with a first type of snap fasteners, and the vest and the strap means fitted with a second type of snap fasteners, and said first type of fasteners being shaped so as to matingly detachably engage a second type of snap fastener, with said snap fasteners located so that the snap fasteners of the harness may engage alternatively the snap fasteners of either the said vest or of the said strap means.

6. The apparatus of claim 5 in which the vest is shaped so that either side of the vest may be worn as the external side of the vest as alternatives mode of use, with snaps located on the vest so that the harness means may be detachably externally mounted on the vest or detached from the vest, in either said alternative mode of use, with the surfaces of one side of the vest surfaced with light reflective means so as to be distinctively visible by reflective light at night, with the other side of the vest formed with a brightly colored surface so as to be distinctly visible in daylight.

* * * * *